US010115349B2

(12) United States Patent
Kim et al.

(10) Patent No.: US 10,115,349 B2
(45) Date of Patent: Oct. 30, 2018

(54) DISPLAY DEVICE

(71) Applicant: LG DISPLAY CO., LTD., Seoul (KR)

(72) Inventors: Hyunchul Kim, Chilgok-gun (KR); Jeongho Kang, Gumi-si (KR)

(73) Assignee: LG DISPLAY CO., LTD., Seoul (KR)

( * ) Notice: Subject to any disclaimer, the term of this patent is extended or adjusted under 35 U.S.C. 154(b) by 85 days.

(21) Appl. No.: 14/962,336

(22) Filed: Dec. 8, 2015

(65) Prior Publication Data

US 2016/0189661 A1 Jun. 30, 2016

(30) Foreign Application Priority Data

Dec. 31, 2014 (KR) ..... 10-2014-0195705

(51) Int. Cl.
*G09G 3/3283* (2016.01)

(52) U.S. Cl.
CPC ... *G09G 3/3283* (2013.01); *G09G 2310/0275* (2013.01); *G09G 2320/0276* (2013.01); *G09G 2330/021* (2013.01); *G09G 2330/028* (2013.01)

(58) Field of Classification Search
CPC ..... G09G 3/3283; G09G 2330/021; G09G 2320/0276; G09G 2330/028; G09G 2310/0275
See application file for complete search history.

(56) References Cited

U.S. PATENT DOCUMENTS

2003/0020677 A1* 1/2003 Nakano ..... G09G 3/3413 345/87
2004/0036457 A1* 2/2004 Tokioka ..... G09G 3/3283 323/281
2004/0239696 A1* 12/2004 Okabe ..... G09G 3/325 345/690
2004/0242171 A1 12/2004 Hosokawa et al.
2007/0132696 A1 6/2007 Yamashita
2010/0156885 A1* 6/2010 Cho ..... G09G 3/006 345/214

* cited by examiner

*Primary Examiner* — Shaheda Abdin
(74) *Attorney, Agent, or Firm* — Dentons US LLP

(57) ABSTRACT

Disclosed is a display device that has a data transmission device for providing a differential signal to a source driver, in which the data transmission device, for example, includes a differential signaling driver including a current controller, the current controller determining a toggling of an image data and setting an output current value based on a determination of the toggling of the image data; and first and second signal lines electrically connected between the differential signaling driver and a receiver, the receiver outputting the differential signal to the source driver.

12 Claims, 7 Drawing Sheets

DISPLAY DEVICE

This application claims the benefit of Korea Patent Application No. 10-2014-0195705 filed on Dec. 31, 2014, the entirety of which is incorporated herein by reference for all purposes as if fully set forth herein.

BACKGROUND OF THE INVENTION

Field of the Invention

The present disclosure relates to a display device and a method of driving the same, and more particularly, to a data transmission device of a display device that can reduce power consumption.

Discussion of the Related Art

Examples of flat panel display devices are liquid crystal displays (LCDs), field emission displays (FEDs), plasma display panel (PDPs), and organic light emitting diode (OLED) displays. In a flat panel display device, data lines and gate lines are typically arranged to cross each other, and a pixel is defined by each of the crossings of the data lines and the gate lines. A plurality of pixels are formed in a matrix form in the display panel of the flat panel display. The flat panel display device supplies a video data voltage to the data lines and sequentially supplies a gate pulse to the gate lines, thereby driving the pixels. The flat panel display supplies the video data voltage to the pixels of a data line to which the gate pulse is supplied, and sequentially scans all of the data lines through the gate pulse, thereby displaying an image corresponding to the video data.

A timing controller of a flat panel display device typically supplies digital video data, a clock for sampling the digital video data, a control signal for controlling operations of source driver integrated circuits (ICs), etc. to the source driver ICs through an interface such as low-voltage differential signaling (LVDS). The source driver ICs convert the digital video data serially received from the timing controller into data of parallel system and then convert the data of the parallel system into an analog data voltage using a gamma compensation voltage. The source driver ICs supply the analog data voltage to the data lines. The LVDS interface produces a differential signal using a current output from a current source of a differential signaling driver.

However, the LVDS interface has relatively high power consumption in a process for increasing reliability of data transmission. Further, a data driver of the flat panel display device includes various buffers. Because a bias current of each buffer is fixed to a predetermined value, the data driver may consume more current than what is necessary.

SUMMARY OF THE INVENTION

Accordingly, the present invention is directed to provide a display device and a method of driving the same that substantially obviate one or more problems due to limitations and disadvantages of the related art.

An advantage of the present invention is directed to providing a display device that can reduce power consumption.

Additional features and advantages of the invention will be set forth in the description which follows, and in part will be apparent from the description, or may be learned by practice of the invention. These and other advantages of the invention will be realized and attained by the structure particularly pointed out in the written description and claims hereof as well as the appended drawings.

To achieve these and other advantages and in accordance with the purpose of the present invention, as embodied and broadly described, a display device has a data transmission device for providing a differential signal to a source driver, in which the data transmission device may, for example, include a differential signaling driver including a current controller, the current controller determining a toggling of an image data and setting an output current value of the variable current source based on a determination of the toggling of the image data; and first and second signal lines electrically connected between the differential signaling driver and a receiver, the receiver outputting the differential signal to the source driver.

In another aspect, a display device may, for example, include a display panel including data lines, a data driver configured to produce a data voltage corresponding to input image data and supply the data voltage to the data lines through an output buffer, and a current controller configured to calculate an amount of change in the image data in the same channel and vary a bias current of the output buffer based on the amount of change in the image data.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE ILLUSTRATED EMBODIMENTS

Reference will now be made in detail to embodiments of the invention, examples of which are illustrated in the accompanying drawings. Wherever possible, the same reference numbers will be used throughout the drawings to refer to the same or like parts.

Figure 1:
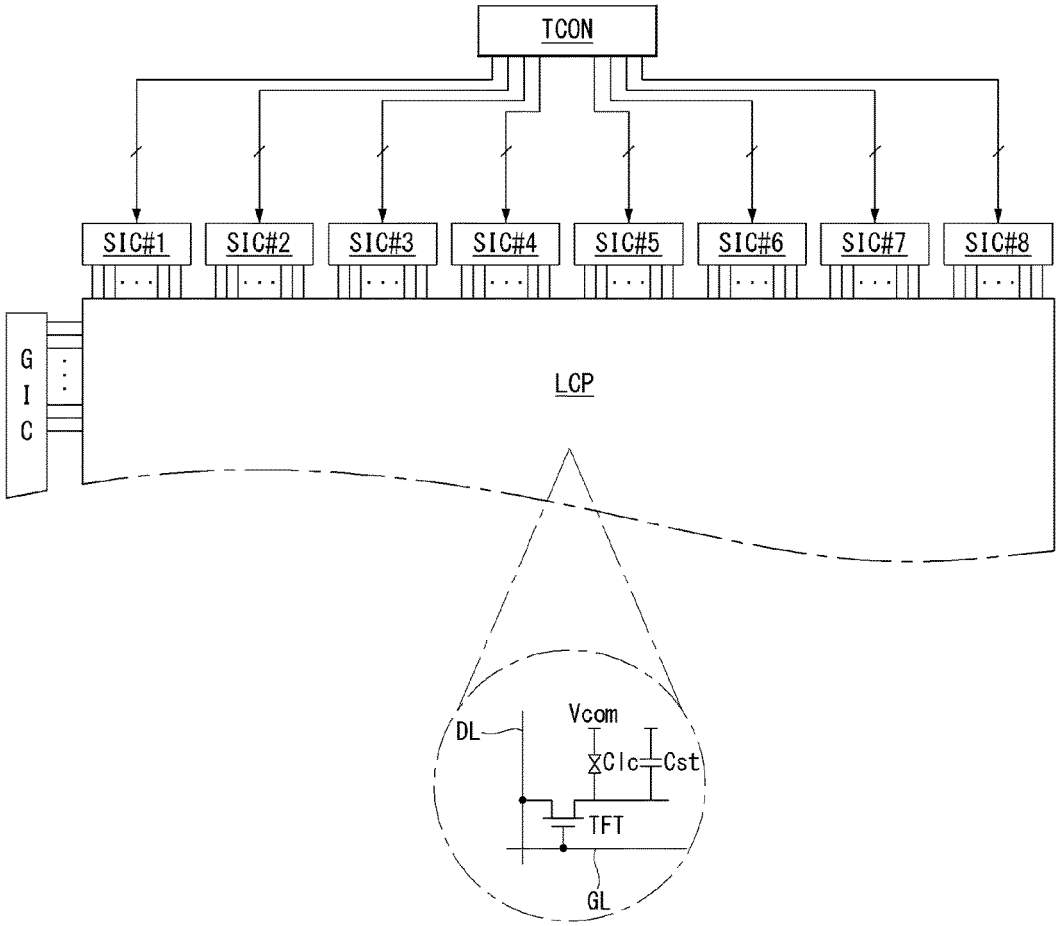
FIG. 1 illustrates a display device according to an exemplary embodiment of the present invention.

FIG. 1 illustrates a liquid crystal display (LCD) device according to an exemplary embodiment of the present invention.

Referring to FIG. 1, the LCD device according to an exemplary embodiment of the present invention includes a liquid crystal display panel LCP, a timing controller TCON, source driver integrated circuits (ICs) SIC#1 to SIC#8, and gate driver ICs GIC.

A liquid crystal layer is formed between two substrates of the liquid crystal display panel LCP. The liquid crystal display panel LCP includes a plurlaity of liquid crystal cells Clc arranged in a matrix form defined by the crossings of data lines DL and gate lines GL.

A pixel array including the data lines DL, the gate lines GL, thin film transistors (TFTs), storage capacitors Cst, etc. is formed on a TFT array substrate of the liquid crystal display panel LCP. Each liquid crystal cell Clc is driven by an electric field between a pixel electrode to which a data voltage is supplied through the TFT and a common electrode to which a common voltage Vcom is supplied. A gate electrode of the TFT is connected to the gate line GL, and a drain electrode of the TFT is connected to the data line DL. A source electrode of the TFT is connected to the pixel electrode of the liquid crystal cell Clc. The TFT is turned on in response to a gate pulse supplied through the gate line GL and then supplies a data voltage from the data line DL to the pixel electrode of the liquid crystal cell Clc.

Black matrixes, color filters, the common electrode, etc. are formed on a color filter substrate of the liquid crystal display panel LCP. Polarizing plates are respectively attached to the TFT array substrate and the color filter substrate of the liquid crystal display panel LCP. Alignment layers for setting a pre-tilt angle of liquid crystals are respectively formed on the TFT array substrate and the color filter substrate of the liquid crystal display panel LCP. A spacer may be formed between the TFT array substrate and the color filter substrate of the liquid crystal display panel LCP to maintain a uniform cell gap of the liquid crystal cells Clc.

The timing controller TCON receives external timing signals, such as a vertical sync signal Vsync, a horizontal sync signal Hsync, an external data enable signal DE, and an external clock CLK, from an external host system (not shown) through an interface, such as a low-voltage differential signaling (LVDS) interface and a transition minimized differential signaling (TMDS) interface.

The timing controller TCON transmits the external clock CLK and RGB digital video data to the source driver ICs SIC#1 to SIC#8 through a data transmission device and pairs of data lines. The timing controller TCON generates control data as a differential signal and transmits the differential signal to the source driver ICs SIC#1 to SIC#8 through the pairs of data lines. The control data includes source control data for controlling output timing, a polarity, etc. of the data voltage output from the source driver ICs SIC#1 to SIC#8. The control data may also include gate control data for controlling operation timing of the gate driver ICs GIC.

The source driver ICs SIC#1 to SIC#8 receive the external clock CLK, the RGB digital video data, and the control data through the pairs of data lines. The source driver ICs SIC#1 to SIC#8 generate a frequency of the external clock CLK as internal clocks of {(the number of bits of RGB digital video data)×2} using a phase locked loop (PLL) or a delay locked loop (DLL). The source driver ICs SIC#1 to SIC#8 sample the RGB digital video data based on the internal clocks and then convert the sampled data into data of parallel system.

The source driver ICs SIC#1 to SIC#8 decode the control data input through the pairs of data lines using a code mapping method and recover the source control data and the gate control data. The source driver ICs SIC#1 to SIC#8 convert the RGB digital video data of the parallel system into positive and negative analog video data voltages in response to the recovered source control data and supply the analog video data voltages to the data lines DL of the liquid crystal display panel LCP. The source driver ICs SIC#1 to SIC#8 may transmit the gate control data to at least one of the gate driver ICs GIC.

The gate driver ICs GIC sequentially supply a gate pulse to the gate lines GL in response to the gate control data that is received from the timing controller TCON or is received through the source driver ICs SIC#1 to SIC#8. The gate control data includes a gate start pulse GSP, a gate shift clock GSC, a gate output enable signal GOE, and the like. The gate start pulse GSP controls a start horizontal line of a scan operation during one vertical period in which one screen is displayed. The gate shift clock GSC is a clock signal that is input to a shift resistor inside the gate driver IC GIC and sequentially shifts the gate start pulse GSP. The gate output enable signal GOE controls an output timing of the gate driver ICs GIC.

Figure 2:
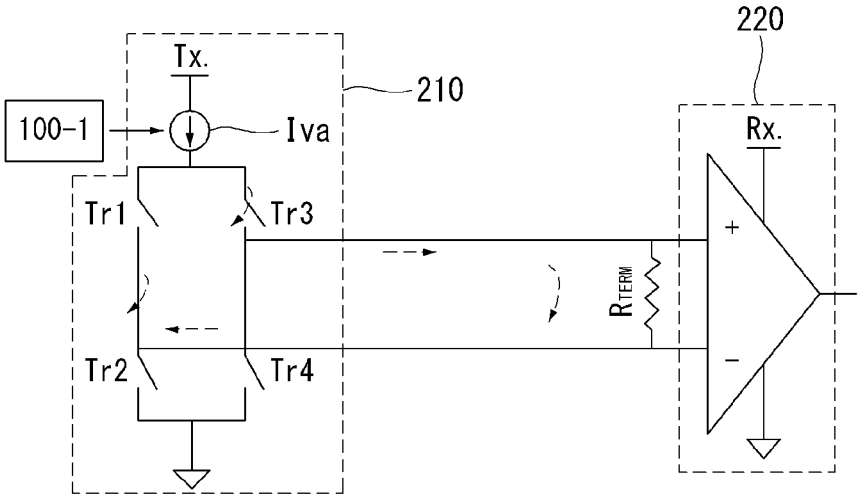
FIG. 2 illustrates a data transmission device according to an exemplary embodiment of the present invention.

FIG. 2 illustrates a configuration of a data transmission device according to an embodiment of the present invention. The data transmission device uses an LVDS interface.

Referring to FIG. 2, the data transmission device according to the embodiment of the present invention includes a differential signaling driver 210, a current controller 100-1, and a receiving unit 220.

The differential signaling driver 210 includes a variable current source Iva and first to fourth switching elements Tr1 to Tr4. The variable current source Iva provides a current corresponding to a control signal received from the current controller 100-1 for a circuit.

The first switching element Tr1 and the fourth switching element Tr4 are turned on in response to a first input signal, and the second switching element Tr2 and the third switching element Tr3 are turned on in response to a second input signal. Each of the first to fourth switching elements Tr1 to Tr4 forms a current loop of a predetermined direction through its switching operation.

The current controller 100-1 sets an output current value of the variable current source Iva of the differential signaling driver 210. The receiving unit 220 outputs a differential signal supplied through a pair of signal lines.

Figure 3:
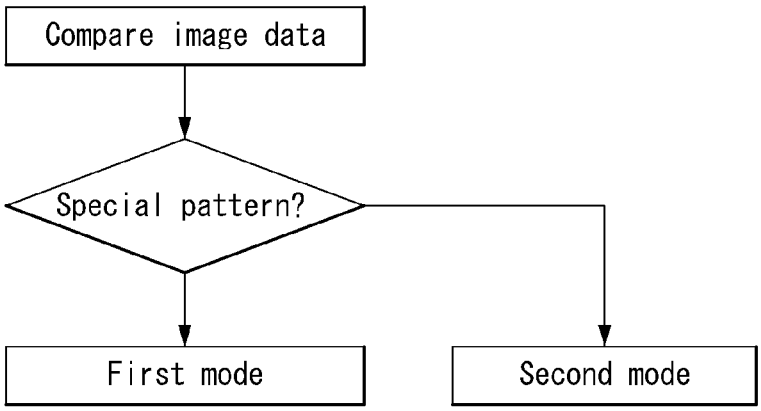
FIG. 3 is a flow chart illustrating a current control method according to an exemplary embodiment of the present invention.

FIG. 3 is a flow chart illustrating a method for setting a loop current according to an embodiment of the present invention, which will now be described in detail.

The current controller 100-1 decides toggling of an image data. For example, the current controller 100-1 divides an image data into unit data of 8 bits and decides a degree of toggling for each unit data. The toggling of an image data means a frequency of change in the image data that is divided into high data or low data.

The current controller 100-1 selects a first mode and a second mode depending on the toggling of an image data. When the toggling of the image data is low (e.g., when a full black image or a full white image is displayed), the current controller 100-1 outputs a first control signal for controlling an operation of the first mode.

Figure 4:
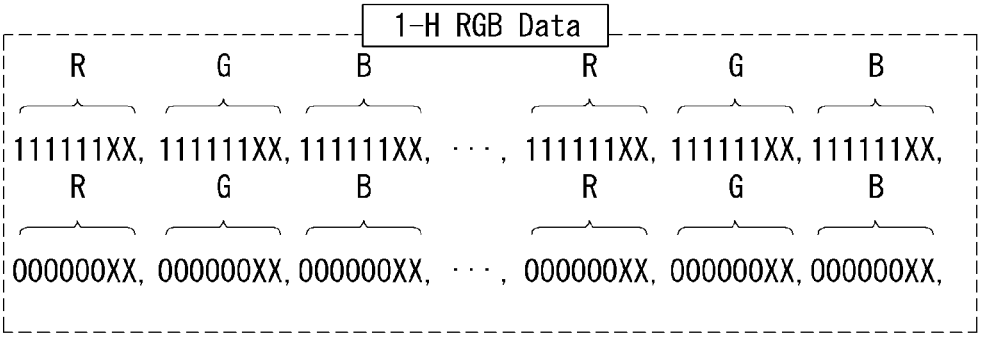
FIGS. 4 and 5 illustrate a method for deciding an image data according to the first embodiment of the present invention.

The current controller 100-1 may decide the toggling of an image data based on upper bits of the image data. In such a process, the current controller 100-1 may decide the toggling of an image data based on the image data belonging to the six upper bits while ignoring the image data belonging to the two lower bits. Because the image data belonging to the two lower bits represent a very small size of display data within a display range of the image data, visibility of an error may be very low even when the image data belonging to the two lower bits are ignored. Thus, the current controller 100-1 may decide the toggling of the image data based on the image data belonging to the six upper bits. As illustrated in FIG. 4, the current controller 100-1 may, for example, output the first control signal when red image data, green image data and blue image data have the same six upper bits.

Figure 5:
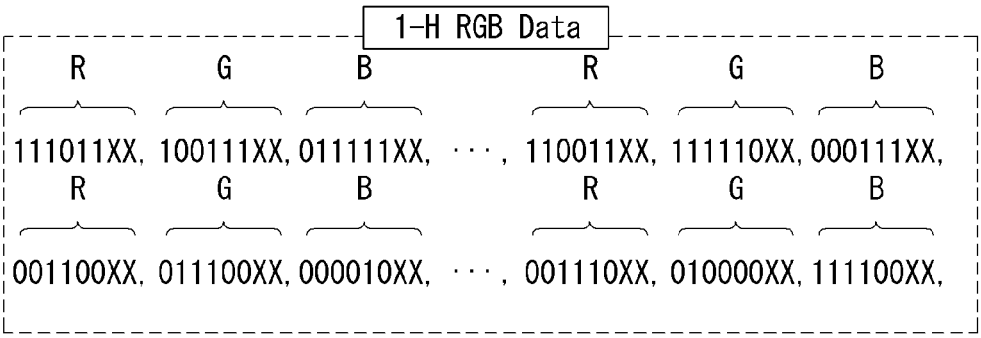

The current controller 100-1 may output a second control signal for controlling an operation of the second mode except when the current controller 100-1 outputs the first control signal. For example, when a different data is detected from the image data belonging to six upper bits, the current controller 100-1 outputs the second control signal. In particular, as illustrated in FIG. 5, the current controller 100-1 may output the second control signal when a different data is detected from the six upper bits of each of the red image data, the green image data, and the blue image data.

Figure 6:
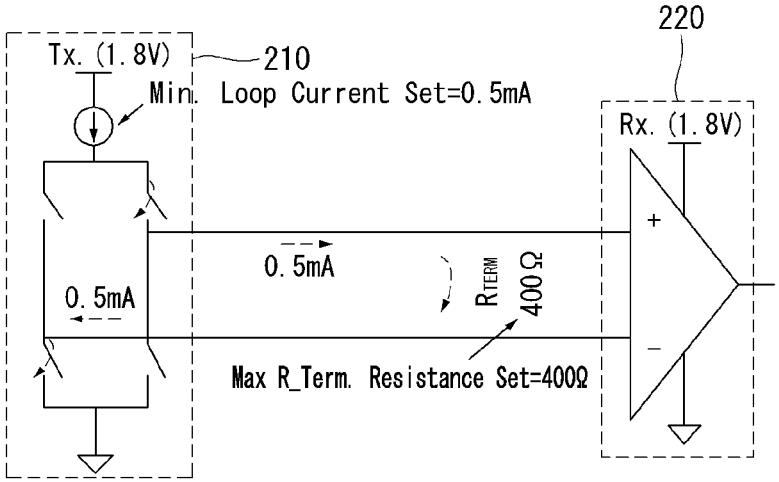
FIGS. 6 and 7 illustrate a current control method according to the first embodiment of the present invention.
Figure 7:
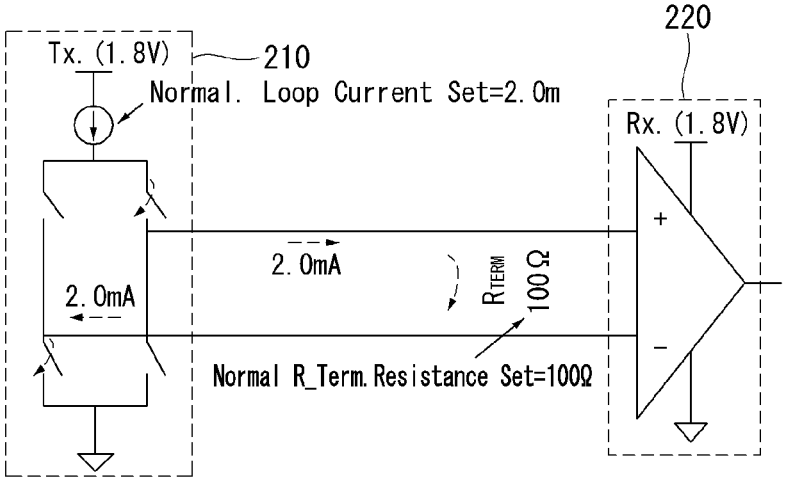

The differential signaling driver 210 sets a current value of the variable current source Iva in response to the control signal received from the current controller 100-1. As illustrated in FIG. 6, when the differential signaling driver 210 receives the first control signal, the differential signaling driver 210 selects a current value smaller than a current value selected when receiving the second control signal. For example, when the differential signaling driver 210 receives the first control signal, the differential signaling driver 210 may select the current of 0.5 mA as a loop current. Also, as illustrated in FIG. 7, when the differential signaling driver 210 receives the second control signal, the differential signaling driver 210 may select the current of 2.5 mA as a loop current.

The differential signaling driver 210 selects the loop current in response to the first control signal or the second control signal, and thus can reduce or prevent reduction in transmission quality of the image data while reducing power consumption. The transmission reliability of an image data is proportional to the loop current. Because the transmission reliability of an image data is improved as the loop current increases, the current controller 100-1 controls the variable current source Iva to select a larger current value when the toggling of the image data is high.

When the loop current increases, the transmission reliability of the image data is improved, but the power consumption increases. Thus, when the toggling of an image data is low, the current controller 100-1 controls the variable current source Iva to select a smaller current value. When the toggling of an image data is low, a transmission error may scarcely occur in a process for transmitting the image data. As a result, the current controller 100-1 selects a small current value of the loop current for reducing power consumption.

The receiving unit 220 varies a terminating resistance Rterm depending on the loop current. The receiving unit 220 varies the terminating resistance Rterm depending on an amount of the loop current so that a differential voltage is uniformly maintained at a predetermined value. When the differential voltage is designed to be uniformly maintained at, for example, 200 mV, the terminating resistance Rterm may be selected as follows: (1) when the loop current is 0.5 mA in response to the first control signal, the receiving unit 220 sets the terminating resistance Rterm to 400Ω, and (2) when the loop current is 2.5 mA in response to the second control signal, the receiving unit 220 sets the terminating resistance Rterm to 100Ω.

As discussed above, the current controller 100-1 outputs the first control signal and the second control signal, and the differential signaling driver 210 controls a variable current based on the first control signal and the second control signal.

The loop current of the differential signaling driver 210 may be selected depending on an optional signal. The following Table 1 shows an example of the loop current that the differential signaling driver 210 sets depending on the optional signal.

TABLE 1

| Optional Signal | Loop Current | Differential Voltage |
|---|---|---|
| LLL | 0 mA | 0 mV |
| LLH | 0.5 mA | 50 mV |
| LHL | 1.0 mA | 100 mV |
| LHH | 1.5 mA | 150 mV |
| HLL | 2.0 mA | 200 mV |
| HLH | 2.5 mA | 250 mV |
| HHL | 3.0 mA | 300 mV |
| HHH | 3.5 mA | 350 mV |

The variable current source Iva of the differential signaling driver 210 may select one of a total of eight optional signals using the control signal received from the current controller 100-1.

Figure 8:
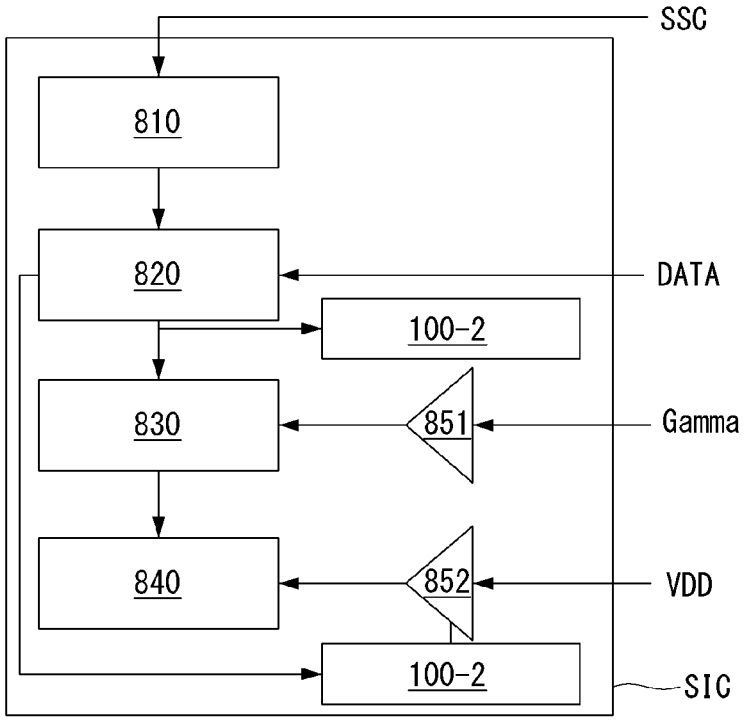
FIGS. 8 and 9 illustrate configuration of a source driver integrated circuit (IC) according to an exemplary embodiment of the present invention.
Figure 9:
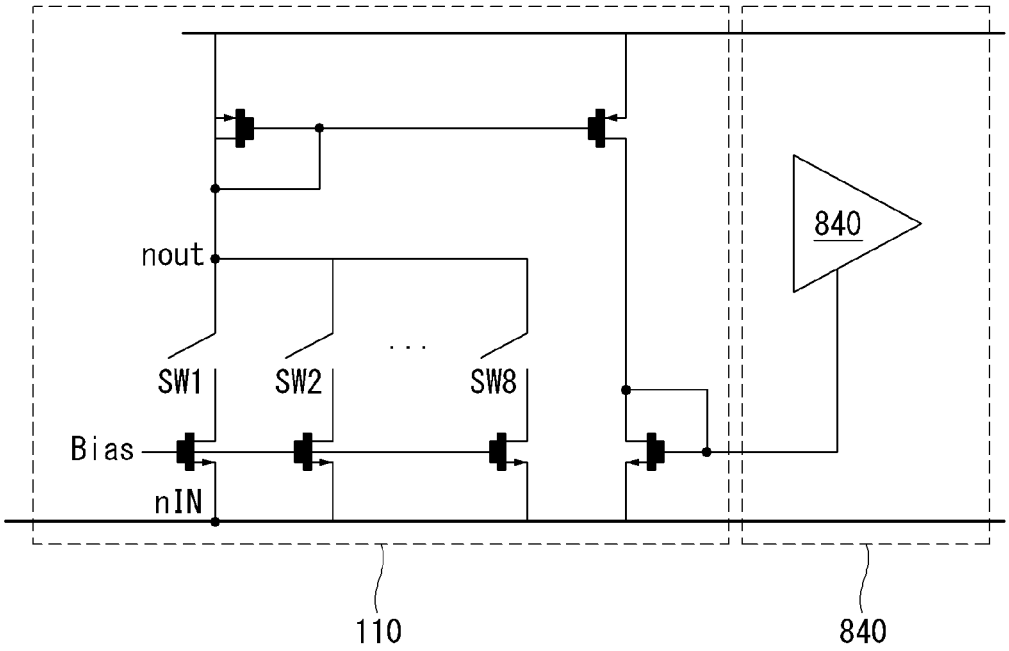

FIGS. 8 and 9 illustrate a configuration of a source driver IC according to an embodiment of the present invention.

Referring to FIG. 8, the source driver IC SIC includes a shift register 810, a latch 820, a digital-to-analog converter (DAC) 830, and an output buffer 840. The shift register 810 samples bits of RGB digital video data of an input image in response to data control signals SSC and SSP received from the timing controller TCON and supplies them to the latch 820. The latch 820 samples and latches the bits of the RGB digital video data in response to a clock sequentially received from the shift register 810. Then, the latch 820 simultaneously outputs the latched RGB digital video data. The latch 820 simultaneously outputs the latched data in response to a source output enable signal SOE in synchronization with the latches 820 of other source driver ICs. The DAC 830 converts the image data into an analog data voltage using a gamma reference voltage Gamma received through a gamma buffer 851. The output unit 840 supplies the analog data voltage output from the DAC 830 to the data lines DL during a low logic period of the source output enable signal SOE. The output unit 840 outputs the data voltage using a low potential voltage GND and a voltage received through a driving voltage output buffer 852.

A current controller 100-2 reads the image data and varies a bias current supplied to the output buffer 840, the gamma buffer 851, and the driving voltage output buffer 852 of the source driver IC SIC. To do so, as illustrated in FIG. 9, the current controller 100-2 includes a switching circuit unit 910. The switching circuit unit 910 includes a plurality of switching elements SW1 to SW8 arranged in parallel between an input node nIN connected to a current source (not shown) and an output node nout connected to the output buffer 840. The switching circuit unit 910 may select the number of switching elements connecting the input node nIN and the output node nout and may adjust a current value.

The current controller 100-2 reads the image data. When an amount of change in the data voltage supplied to the same data line is equal to or less than a critical value, the current controller 100-2 controls an amount of the bias current of the output buffer 840, the gamma buffer 851, and the driving voltage output buffer 852.

The current controller 100-2 reads the image data on a line-by-line basis. For example, the current controller 100-2 compares data of a first line supplied during a first horizontal period 1H with data of a second line supplied during a second horizontal period 2H. The current controller 100-2 compares the image data with respect to bits of the same location (the same order). When an amount of change in the image data belonging to the same location is equal to or less than the critical value, the current controller 100-2 varies the bias current.

The critical value may be determined depending on driving reliability and power consumption. When the critical value is high, driving reliability of the buffers can be reduced because the bias current varies even when an amount of change in an image data is large. On the other hand, when the critical value is low, driving reliability of the buffers can increase, but reduction effect of power consumption can be reduced.

Figure 10:
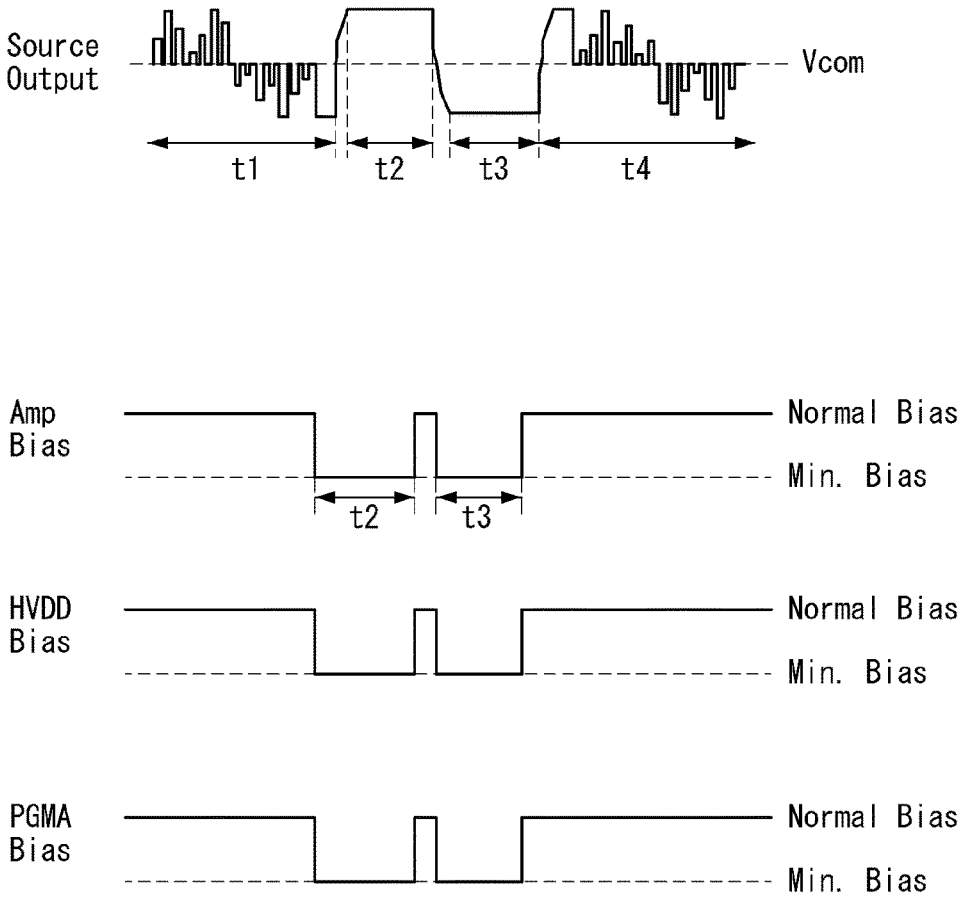
FIG. 10 illustrates a method for deciding image data according to the second embodiment of the present invention.

FIG. 10 illustrates an example where the current controller 100-2 reads an image data and varies a bias current.

Referring to FIG. 10, during a first period t1, the image data has a large change in the data voltage. Thus, the current controller 100-2 does not vary the bias current of the buffers during the first period t1. On the other hand, during a second period t2 and a third period t3, the current controller 100-2 holds a constant data voltage. Namely, the current controller 100-2 varies the bias current of the buffers during the second period t2 and the third period t3. For example, as illustrated in FIG. 10, the current controller 100-2 may set the bias current of the buffers to a minimum value Min.Bias—during the second period t2 and the third period t3. Subsequently, the current controller 100-2 does not vary the bias current of the buffers during a fourth period t4 in which there is a large change in the data voltage.

It will be apparent to those skilled in the art that various modifications and variation can be made in the present invention without departing from the concepts and scope of the invention. Thus, it is intended that the present invention cover the modifications and variations of this invention provided they come within the scope of the appended claims and their equivalents.

What is claimed is:

1. A display device having a data transmission device for providing a differential signal to a source driver, the data transmission device comprising:

a differential signaling driver including a current controller, the current controller dividing an image data into unit data of multi-bits, determining a toggling for each unit data of the image data on a basis of a frequency of change in the image data, and setting an output current value based on a determination of the toggling for each unit data of the image data; and first and second signal lines electrically connected between the differential signaling driver and a receiver, the receiver outputting the differential signal to the source driver.

2. The display device of claim 1, wherein the differential signaling driver further includes a variable current source to set the output current value.

3. The display device of claim 1, wherein the current controller reduces the output current value when one of a low data and a high data of the image data is equal to or greater than a critical value.

4. The display device of claim 1, wherein the first and second signal lines maintain a loop current in response to a signal output from the differential signaling driver.

5. The display device of claim 1, wherein the current controller divides the image data into unit data of 8 bits and reduces the output current value when the number of same data is six or more bits in any one unit data among the unit data.

6. The display device of claim 1, wherein the current controller divides the image data into unit data of 8 bits and reduces the output current value when unit data has the same six upper bits.

7. The display device of claim 6, wherein the current controller divides each of red image data, green image data, and blue image data into unit data of 8 bits and reduces the output current value when the red image data, the green image data, and the blue image data have the same six upper bits.

8. The display device of claim 1, further comprising a terminating resistor between the first and second signal lines, wherein the current controller adjusts a resistance of the terminating resistor so that the resistance of the terminating resistor is inversely proportional to the output current value.

9. A display device comprising:

a display panel including data lines;

a data driver configured to produce a data voltage corresponding to input image data and supply the data voltage to the data lines including first and second data lines through an output buffer; and a current controller configured to read the image data on a line-by-line basis, compare the image data of the first data line for a first horizontal period with the image data of the second data line for a second horizontal period, calculate an amount of change in the image data between the first and second data lines for displaying an image in a same channel, and vary a bias current of the output buffer based on the amount of change in the image data.

10. The display device of claim 9, wherein the current controller performs an operation reducing the bias current of the output buffer as the amount of change in the image data decreases.

11. The display device of claim 9, wherein the data driver receives a gamma reference voltage through a gamma buffer so as to convert the image data into the data voltage, and wherein the current controller performs an operation reducing a bias current of the gamma buffer as the amount of change in the image data decreases.

12. The display device of claim 9, wherein the data driver receives a high potential voltage through a driving voltage output buffer, and wherein the current controller performs an operation reducing a bias current of the driving voltage output buffer as the amount of change in the image data decreases.

* * * * *